United States Patent [19]

Nasser

[11] 4,293,033

[45] Oct. 6, 1981

[54] PLATE-TYPE HEAT EXCHANGER

[75] Inventor: Gamal E. D. Nasser, Puchheim, Fed. Rep. of Germany

[73] Assignee: Linde Aktiengesellschaft, Wiesbaden, Fed. Rep. of Germany

[21] Appl. No.: 53,277

[22] Filed: Jun. 29, 1979

[51] Int. Cl.[3] ..... F28F 3/08

[52] U.S. Cl. ..... 165/166

[58] Field of Search ..... 165/166, 167

[56] References Cited

U.S. PATENT DOCUMENTS

| | | | |
|---|---|---|---|
| 2,959,400 | 11/1960 | Simpelaar . | |
| 3,111,982 | 11/1963 | Ulbricht | 165/166 |
| 3,428,141 | 2/1969 | Forstner et al. | 165/166 X |
| 3,473,604 | 10/1969 | Tiefenbacher | 165/166 |
| 3,731,736 | 5/1973 | Fernandes | 165/166 |
| 3,783,090 | 1/1974 | Andersson et al. | 165/166 |
| 4,029,146 | 6/1977 | Hart et al. | 165/166 |

FOREIGN PATENT DOCUMENTS

| | | | |
|---|---|---|---|
| 1501499 | 4/1970 | Fed. Rep. of Germany . | |
| 2030080 | 1/1971 | Fed. Rep. of Germany . | |
| 2165267 | 7/1973 | Fed. Rep. of Germany | 165/166 |
| 2340003 | 2/1975 | Fed. Rep. of Germany . | |
| 350382 | 1/1906 | France . | |
| 1582377 | 9/1969 | France . | |
| 193732 | 2/1938 | Switzerland . | |

*Primary Examiner*—Sheldon J. Richter

*Attorney, Agent, or Firm*—Karl F. Ross

[57] ABSTRACT

A plate-type heat exchanger consisting of pairs of plates having longitudinal and transverse corrugations and forming a sinusoidal cross section with each pair of plates defining between them flow channels through the corrugations thereof. The corrugations in the longitudinal direction of the two plates of a plate pair register with one another whereas the corrugations in the transverse direction of a first plate are offset from the transverse corrugations of a second plate by half a wavelength (spacing of corresponding points of successive corrugations) while between the plate pairs bars are disposed which run along longitudinal corrugations of successive plate pairs and thus form longitudinal channels of an undulating flow pattern. Each plate of one of the plate pairs is mirror-symmetrical to or a mirror image of the closest plate of the next plate pair.

5 Claims, 4 Drawing Figures

FIG. 2
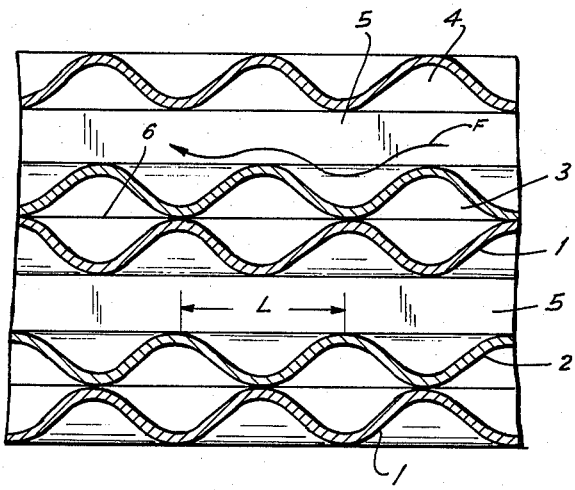
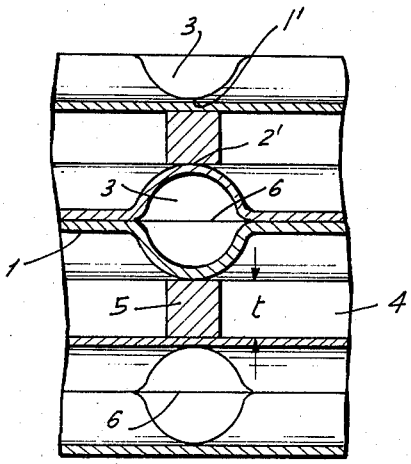
FIG. 3

PLATE-TYPE HEAT EXCHANGER

FIELD OF THE INVENTION

The present invention relates to a plate-heat exchanger and, more particularly, to a heat exchanger formed from a stack of corrugated plates which have a sinusoidal cross section and in which adjoining plates forming a plate pair define substantially tubular flow passages for one of the fluid media.

BACKGROUND OF THE INVENTION

Plate-type heat exchangers formed from stamped or pressed sheets or plates of metal have been provided heretofore. The sheets or plates may have corrugations or undulating patterns.

In such an arrangement, the plates are formed into plate pairs and the plate pairs are assembled into a stack of plates.

The corrugations are arranged so that the two media to flow in heat exchange are passed generally in cross flow through respective passages in indirect heat-exchanging relationship across walls formed by the corrugated plates.

In such systems, the corrugations in the transverse direction can form tube-like passages whereas the corrugations in the longitudinal direction form undulating flow passages or gaps for another medium.

A disadvantage with conventional systems of this type is that the length of the respective flow path cannot be established for a given area of the plate and number of plates, the system is not readily adaptable for a variety of heat exchange requirements, and the heat exchanger as a whole cannot be set to accommodate a wide range of operating conditions. In particular it is difficult to control the throughput of the working media.

In general a plate-type heat exchanger is intended to effect indirect heat exchange across a wall of sheet material between two fluid media, e.g. a gas and a liquid, although both media may be gaseous or liquid as desired.

OBJECTS OF THE INVENTION

It is the principal object of the present invention to provide a plate-type heat exchanger whose flow resistance in at least one direction and for at least one medium can be readily varied or established for a given plate area, heat-exchanger length and heat exchanger width.

Another object of this invention is to provide an improved heat exchanger of the plate type which can accommodate fluids of different types and for different purposes.

SUMMARY OF THE INVENTION

These objects and others which will become apparent hereinafter are attained, in accordance with the present invention in a plate-type heat exchanger composed of pairs of mirror-image plates corrugated in the longitudinal and transverse directions and of rectangular outline so as to be elongated in the longitudinal direction. According to the invention, the pair of plates define tube-like flow passages in the transverse direction where the open side of mirror-image corrugations register with one another while the pair of plates define between them undulating flow passages in the longitudinal direction for another medium.

According to an important aspect of the present invention, the transverse corrugations of a first plate are offset relative to the transverse corrugations of the second plate by half a "wavelength" while bars are provided between these two plates which together define the undulating longitudinal flow passages between them. These bars lie along corrugations in the longitudinal direction so as to subdivide the longitudinal flow into a multiplicity of flow channels which can be traversed by the medium passing in the longitudinal direction in one direction or the opposite direction to provide any desired flow cross section and any desired path length.

Each plate of a plate pair is a mirror image of the neighboring plate of the next plate pair.

According to the invention, therefore, one medium traverses the tube-like passages in the transverse direction while the other or working medium flows through the undulating passages between the plate pairs, these passages being subdivided from one another by the bars running along longitudinal corrugations whose crests bear upon opposite sides of the respective bars and seal the individual undulating passages from one another.

While such a heat exchanger has all the thermodynamic advantages of a cross flow indirect heat transfer plate-type heat exchanger, it also prevents the effective path length of the working medium to be established simply by positions flow diverters at either end of the heat exchanger and deflecting the stream from a selected number of these longitudinal passages into another selected number of longitudinal passages for flow in the opposite direction and back as many times as is required.

A further advantage of the present invention gained by the provision of bars between the two plates having their transverse corrugations offset by half a wavelength, is that the spacing of these two plates can be established by the bar thicknesses. This establishes the width of the undulating longitudinal flow passages so that the flow resistance thereof can be readily set so as to minimize the pressure drop within the heat exchanger.

According to another invention, between adjacent plate pairs, metal foils can be inserted which can, for example, subdivide the tubular flow passages and which has the advantage of increasing the heat exchange contact area. In practice this has been found to increase the heat exchange efficiency without materially increasing the mass of the heat exchanger. The foils act as partitions for the fluid as well as additional heat exchange surfaces.

So that the plate stack is structurally stable and easily transported, it is advantageous to sandwich the stack between two rigid pressure plates on opposite sides of the stack and to press the stack between these pressure plates by tension rods. The tension rods have also been found to assist in taking up pressure stresses within the stack and hence in preventing enlargement or spreading of the plates thereof upon the development of excess pressures in the heat exchanger without materially increasing the amount of material required for the heat exchanger or the mass thereof.

BRIEF DESCRIPTION OF THE DRAWING

The above and other objects, features and advantages of the present invention will become more readily apparent from the following description, reference being made to the accompanying schematic or diagrammatic drawing in which:

FIG. 2 is a section taken along the line II—II of FIG. 1 drawn to an enlarged scale;

FIG. 3 is a section taken along the line III—III of FIG. 1 drawn to the same scale as FIG. 2.

SPECIFIC DESCRIPTION

Figure 4:
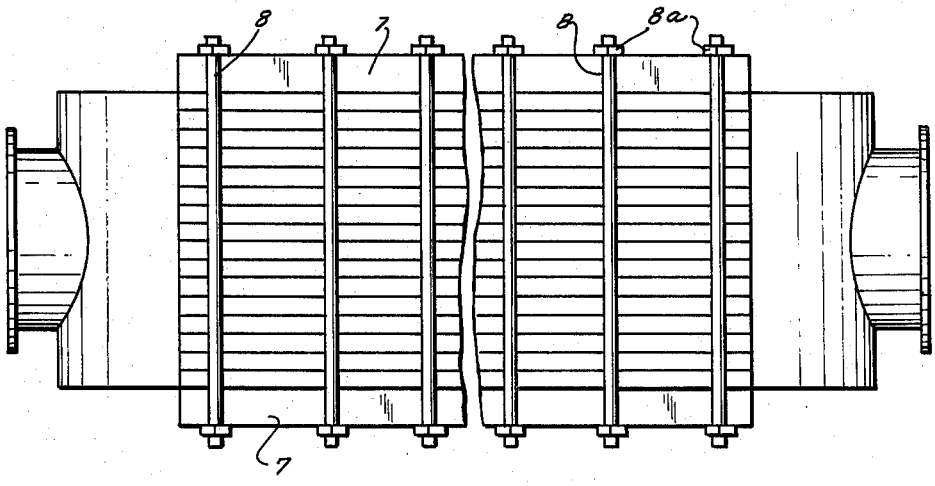
FIG. 4 is a diagrammatic plan view of the heat exchanger of FIG. 1 showing the tension rods of the present invention.

As can be seen from FIGS. 1 and 4, the horizontally elongated heat exchanger can comprise a stack S of corrugated plates which will be described in greater detail hereinafter.

The stack of plates is sandwiched a pair of pressure plates 7 which are rigid and have marginal portions 7*a* and 7*b* extending above and below the stack. The plates 7 are provided with bores 7*c* along their marginal portions 7*a* and 7*b*, which are traversed by tension rods 8 clamped in place by nuts 8*a* tightened onto the threaded ends of these rods.

The tension rods 8 thus stabilize the assembly against internal pressure within the plate-type heat exchanger. At the upper and lower sides of the stack, the stack is open to permit passage of one fluid in the vertical direction, e.g. as represented by the arrows A in FIG. 1.

At each end of the heat exchanger, there is provided a cylindrical segmental housing 9, 9*a* communicating with a cylindrical fitting 9*b* or 9*c*, each having a flange 9*d*, 9*e* for connection to a source of the working fluid (at the right side of the heat exchanger) and to a duct (left side of the heat exchanger) for conducting the fluid away from the heat exchanger.

The cylindrical segmental housings 9 and 9*a* are internally partitioned by plates 9*f* and 9*g* which can be set to connect any number of undulating longitudinal flow channels with one another. For example, the partition 9*g* defines an inlet compartment 9*h* in the housing at the right hand side of the heat exchanger which it opens into certain longitudinal undulating flow channels to which the working medium is fed as represented by the arrows B.

The housing 9 at the left hand side of the heat exchanger has a partition 9*f* which forms a chamber 9*i* interconnecting these flow channels with another set of flow channels to divert the flow of fluid in the direction of arrow C for a return pass in the opposite direction.

Another chamber 9*i* is defined in housing 9*a* by the partition 9*g* to again return the fluid as represented by the arrow D through further flow channels in the longitudinal direction from which the fluid emerges into the chamber 9*k* in the direction of arrows E to pass out of the heat exchanger.

From FIG. 2 it will be apparent that the stack of heat exchanger plates is formed by corrugated plates 1 and 2 which lie against one another and form a plate pair, the plate pairs being assembled into the stack with intervening bars 5 between them. Each plate pair 1, 2 defines tubular passages 3 which are separated by the thickness of the plates from the longitudinal undulating flow passages or gaps represented at 4. The path of the fluid through the longitudinal flow passages is represented by the arrow F in FIG. 2 while the flow through the tubular passages 3 is perpendicular to the plane of the paper in FIG. 2. The plates 1 and 2 are thus provided with longitudinal and transverse corrugations with the wavelength being represented at L between corresponding points of successive corrugations. A half wavelength is thus represented by L/2.

Figure 1:
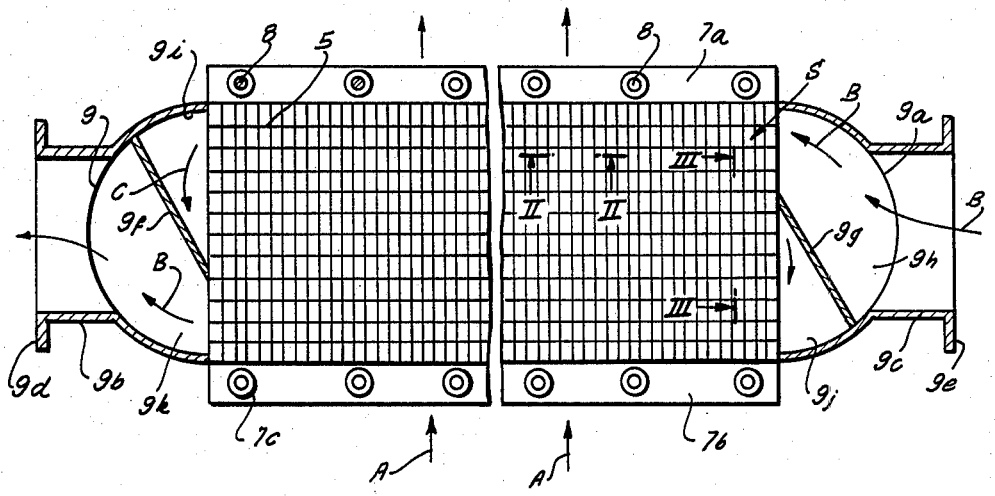
FIG. 1 is a vertical section through a heat exchanger according to the invention which shows the plates and bars only diagrammatically because of their small thicknesses and sizes relative to the overall size of the heat exchanger.

The tubular passages 3 run, in FIG. 1, from bottom to top, i.e. transversely, while the undulating gaps 4 run from right to left, i.e. longitudinally.

The working medium traversing the undulating flow passages 4 is diverted at opposite ends of the plate-type heat exchangers in the manner previously described so that any desired path length can be attained. Naturally, more than two such plates 9*f*, 9*g* can be provided. It is only necessary that the plates 9*f* and 9*g* proximal to the stack lie at bars 5 which extend longitudinally along longitudinal crests 1′, 2′ of the spaced-apart plates so that each chamber 9*h*, 9*i*, 9*j*, 9*k* communicates with a corresponding number of longitudinal flow passages. Thus the two fluids pass in cross flow in indirect heat exchange.

For example, air can flow through the tubular passages 3 when the heat exchanger is used in an air coolant. By contrast with other air coolers, for example, of the ribbed-tube type, the heat exchanger material can be relatively high quality substance, e.g. stainless steel. The use of high quality material, because of the poor heat conductivity characteristics, is permissible in such plate-type heat exchangers with their special thermodynamic properties where they would not be permissible in finned-tube or like heat exchangers.

The heating of cooling medium, i.e. the working medium, can be water or the working medium can be some other fluid. When water traverses the heat exchanger in the direction of arrow A, there is the disadvantage that the tubular passages are more rapidly contaminated and that the water must be additionally cooled in a trickle tower or the like.

As noted previously, the throughput of the cooling media can be readily varied for a constant width of the plates by modifying the depths of the corrugations forming the tubular passages 3. The throughput of the working medium can be varied by modifying the thicknesses t of the bars 5.

As has been shown in FIG. 2, metal foils 6 can be disposed between two adjacent plate pairs or between the plates of a pair to improve the heat transfer characteristics.

The heat exchanger of the present invention has been found to be especially effective when used in a demisting apparatus or in association with a cooling tower. It can, however, also be used effectively in heat pumps, dry cooling towers or in the condenser unit of seawater desalination installations.

I claim:

1. A plate-type heat exchanger comprising:

a plate stack composed of a multiplicity of substantially identical elongated sheet metal plates each formed with longitudinal and transverse intersecting arrays of corrugations having a generally sinusoidal cross section, each two plates forming a plate pair, and being disposed in mirror-image relationship with troughs of corresponding transverse corrugations opening toward one another and defining tubular transverse passages for one fluid medium, the corrugations in the longitudinal direction of the plates of each plate pair lying above one another, the corrugations in the transverse direction of each plate of one plate pair being offset from the transverse corrugations of a juxtaposed plate of the next plate pair by a half wavelength;

bars disposed between juxtaposed plates of successive plate pairs and in continuous contact with crests of the respective longitudinal corrugations whereby undulating longitudinal flow passages are formed between said bars for another fluid medium and said longitudinal flow passages are separated from one another by said bars; and means for feeding at least one of said mediums to the corresponding passages of said stack.

2. The heat exchanger defined in claim 1, further comprising metal foils received between plates of each pair.

3. The heat exchanger defined in claim 1 or claim 2, further comprising a pair of rigid pressure plates sandwiching said stack between them and pressed against said stack by tension rods.

4. The heat exchanger defined in claim 3 wherein said means includes a generally cylindrical housing at each longitudinal end of said stack, each of said housings being internally subdivided by deflecting plates whereby the medium traversing the undulating passages is diverted back and forth through said stack in the longitudinal direction.

5. The heat exchanger defined in claim 4 wherein said plates are composed of stainless steel.

* * * * *